US005337765A

United States Patent [19]

Wong

[11] Patent Number: 5,337,765

[45] Date of Patent: Aug. 16, 1994

[54] MODULAR BRUSH FOR USER-SELECTED HAIR STREAKING

[76] Inventor: Hilda C. Wong, 14701 Saltamontes Way, Los Altos Hills, Calif. 94022

[21] Appl. No.: 13,304

[22] Filed: Feb. 4, 1993

[51] Int. Cl.[5] ..... A45D 24/16

[52] U.S. Cl. ..... 132/120; 132/142

[58] Field of Search ..... 132/120, 141, 152, 153, 132/154, 208, 212, 142; 15/194, 202

[56] References Cited

U.S. PATENT DOCUMENTS

| | | | |
|---|---|---|---|
| 692,387 | 2/1902 | Uhlmann | 15/202 |
| 819,444 | 5/1906 | Monroe . | |
| 961,127 | 6/1910 | Helm | 132/120 |
| 1,671,334 | 5/1928 | White | 15/202 |
| 2,123,043 | 7/1938 | Hertzberg | 132/85 |
| 2,238,603 | 4/1941 | Runnels | 132/85 |
| 2,277,682 | 3/1942 | Brighton | 15/202 |
| 2,648,082 | 8/1953 | Teetsel | 15/202 |
| 3,133,546 | 5/1964 | Dent | 132/154 |
| 3,180,342 | 4/1965 | Dietsche | 132/120 |
| 3,349,781 | 10/1967 | Poole et al. | 132/7 |
| 4,196,489 | 4/1980 | Hahn | 15/159 R |
| 4,358,660 | 11/1982 | Andis | 132/142 |
| 4,368,376 | 1/1983 | Andis | 132/142 |
| 4,475,563 | 10/1984 | Martin | 132/85 |
| 4,519,110 | 5/1985 | Rubin | 15/159 R |
| 4,691,720 | 9/1987 | Schmitz | 132/112 |
| 4,932,425 | 6/1990 | Chen | 132/119 |
| 4,993,438 | 2/1991 | Hunt | 132/139 |
| 5,062,435 | 11/1991 | Ohtsuka | 132/108 |
| 5,246,936 | 9/1992 | Ng | 132/208 |

FOREIGN PATENT DOCUMENTS

| | | | |
|---|---|---|---|
| 890939 | 9/1953 | Fed. Rep. of Germany | 15/202 |
| 996183 | 12/1951 | France | 132/120 |
| 2588459 | 4/1987 | France | 132/212 |
| 309724 | 11/1955 | Switzerland | 132/120 |
| 427663 | 4/1935 | United Kingdom | 132/120 |

*Primary Examiner*—Gene Mancene
*Assistant Examiner*—Frank A. LaViola
*Attorney, Agent, or Firm*—Schneck & McHugh

[57] ABSTRACT

A modular brush for applying hair coloring in a user-selected pattern includes a brush body and a plurality of detachable bristle modules. The bristle modules have tightly packed bristles that retain a volume of hair treatment solution, such as dye after the bristles have been dipped into a supply of the solution. The modules may be arranged to achieve the user-selected pattern of hair coloring. The supply or number of supplies of the solution may be provided by a modular tray.

10 Claims, 6 Drawing Sheets

MODULAR BRUSH FOR USER-SELECTED HAIR STREAKING

DESCRIPTION

1. Technical Field

The present invention relates generally to hair treatment and more particularly to devices for applying a hair-coloring solution.

2. Background Art

Hair streaking is the art of dying selected strands of hair to achieve a desired appearance. Streaking includes a number of variations, such as highlighting, lowlighting, frosting, tipping and color texturing.

Prior art streaking procedures are both difficult and cumbersome. One such procedure is described in U.S. Pat. No. 3,349,781 to Poole et al. A hair stylist parts the hair of a person into sectors by combing one sector of hair over the top of the person's head. A protective sheet of material is placed adjacent to the lower portion of the sector. A lower layer of hair is combed from the laid-up sector down onto the protective sheet. A brush having a series of spaced tufts of bristles is used to apply spaced parallel streaks of dye to the layer of hair on the protective sheet. A second protective sheet is then placed on the treated layer and a second layer of laid-up hair is combed downwardly onto the second sheet. The brush is again used to form the parallel streaks of colored hair. This is continued for each sector of the person's scalp.

Another known procedure is to place a cap having a number of holes onto the head of a person. Depending upon the desired pattern of hair streaking, strands of the person's hair are pulled through the holes in the cap. The exposed strands can then be colored using one shade or several different shades of dye.

A third known procedure of hair treatment providing different shades of hair coloring is to dip a brush into a first shade of dye solution and use the brush to apply the first shade in a random pattern, whereafter the brush is dipped into a second shade of dye solution and is used to apply the second shade between previously dyed areas of hair. This can be repeated for each shade that is desired.

There are a number of disadvantages to use of these procedures. Self-application is difficult, and the result is uncertain, particularly if hair at the back of a person's scalp is to be dyed. At a beauty salon, hair streaking is time consuming and expensive.

Another method that is even more difficult to practice without the aid of a skilled stylist is one that includes wrapping strands to be dyed with one or more shades of color within an aluminum foil. Regardless of which of the above-described procedures is used, a certain amount of discomfort or unreliability accompanies the process.

It is an object of the present invention to provide a brush for applying hair coloring in a relatively easy, reliable, comfortable and repeatable selfapplying pattern that is selected by the user. It is a further object to provide such a brush that enables the user to simultaneously apply several shades of hair coloring.

SUMMARY OF THE INVENTION

The above objects have been met by a brush that is structurally adaptable to achieve a variety of hair streaking patterns, and to retain different shades of coloring within different rows of bristle tufts, so that a single application of the brush to a user's hair will provide alternating shades of dyed hair. The brush is a modular device that permits repositioning of bristle tufts according to taste. Bristle modules and spacer modules may be selectively positioned along a brush body to provide a configuration of bristles and spaces that streak hair as desired merely by applying hair coloring to the bristles and brushing the user's hair. Those areas of the user's hair which come into contact with the bristles on the bristle modules are dyed, while hair that is between the bristle modules retains its natural color. The bristle modules and spacer modules are removable, thereby allowing different shades to be applied to the bristles by removing the modules and dipping them into separate reservoirs of different hair coloring solutions.

In a first embodiment, the bristle modules and the spacer modules are rings which slide onto a cylindrical portion of the brush body. The exterior of the bristle modules is comprised of flat sides which have bristles extending therefrom. Because the bristles are mounted on flat sides, they can retain a tightly packed relationship along their entirety. Closely tufted bristles can more reliably pick up and maintain a volume of coloring solution. Curvature of surfaces will cause the bristles to flare out. While some curvature is possible, the preferred embodiment is one in which the bristles extend from planar surfaces.

In a second embodiment, bristle modules are able to slide onto one of a number of sides of a brush body. A module may have spaces or may be a continuous array of bristles. In both of the above-described embodiments, dye can be applied to each of the many sides of the brush, whereafter the brush is brought into contact with a person's hair and moved downwardly while rotating the brush. The multi-sided brush will provide a fresh supply of dye as the brush is rotated from one tuft of bristles to the next.

All of the bristles may receive the same shade of dye, but this is not critical. Different shades may be applied to each of the sections of bristles on a side of the brush. For example, one ring of bristles may be used to highlight a person's hair, while an adjacent ring can be used to provide lowlighting, i.e. darkening.

In a third embodiment, the modular brush is one having a single side of bristles. Bristle modules may be slidably received along the length of a brush body. While the multi-sided embodiments are preferred because they provide a sequence of fresh supplies of solution with the rotation of the brush, a single-sided brush may be used for hair streaking procedures such as tipping and frosting.

The bristle modules may have a center array with a high bristle density and opposed end arrays that sandwich the high density bristles. Depending upon the direction of movement, one end array will lead the center array and will perform a combing function to aid in properly spreading the dye solution.

The multi-sided brushes may be used with a modular tray that can be selectively resegmented to correspond with the pattern of bristles selected by a user. During the hair streaking procedure, the bristles of the modular brush are inserted into dye-containing segments of the modular tray. The brush is then rolled to ensure that the bristles of each side of the brush receive a quantity of the dye. The closely packed bristles retain a volume of the dye as the brush is removed from the tray.

An advantage of the present invention is that modularity allows the user to construct the brush and to rearrange the device as tastes and styles change. The present invention provides a device that facilitates self-application of dye solutions, even if more than one shade is to be applied at a single time.

BEST MODE FOR CARRYING OUT THE INVENTION

Figure 1:
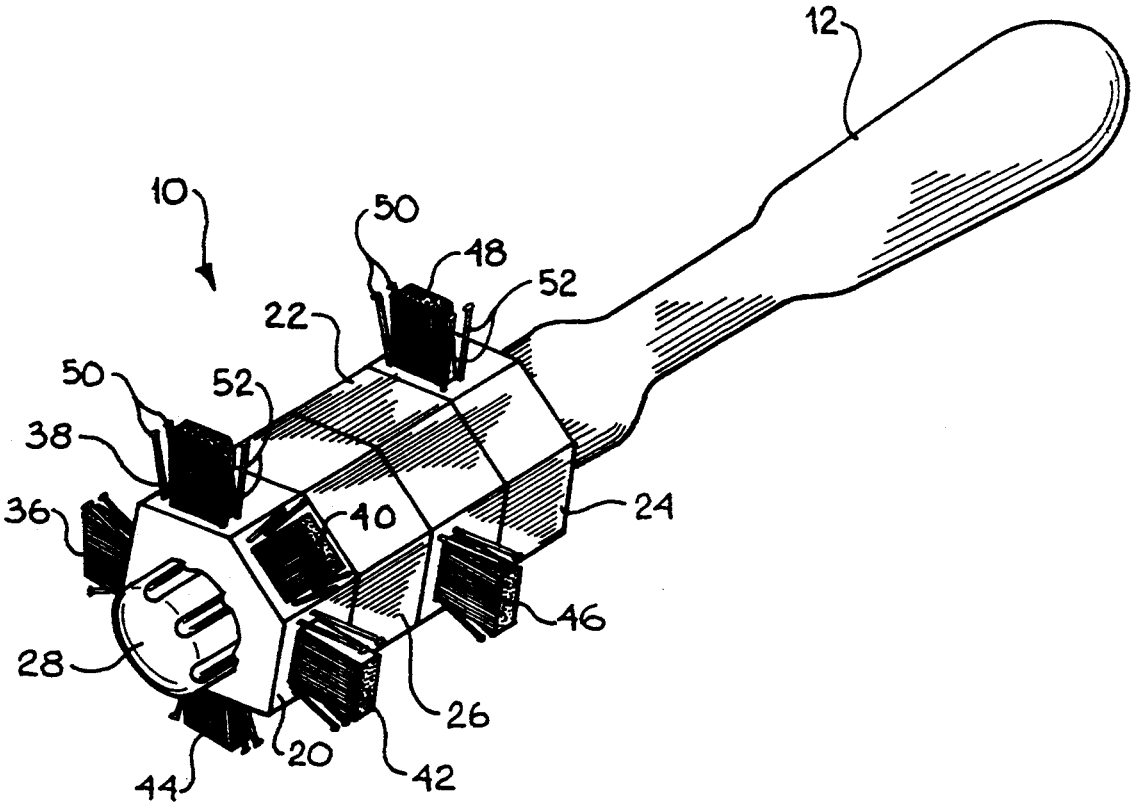
FIG. 1 is a perspective view of a modular brush in accordance with the present invention.
Figure 2:
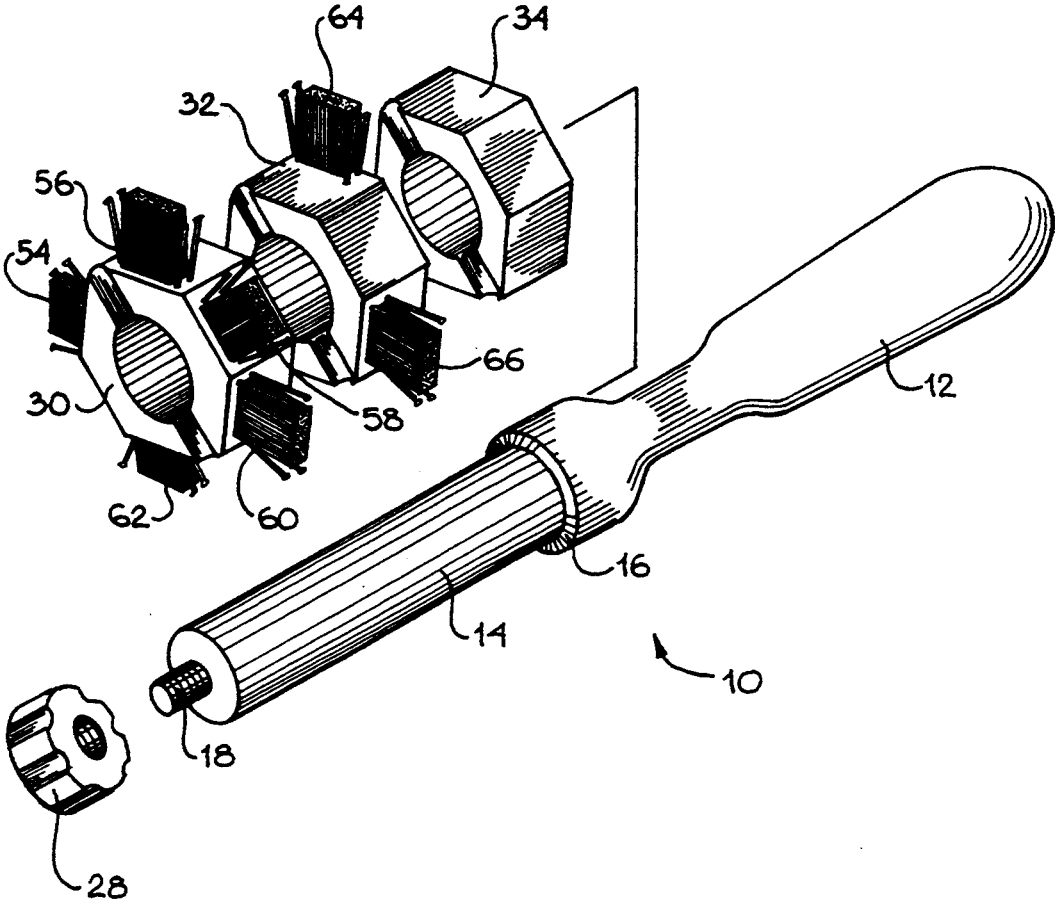
FIG. 2 is an exploded view of the brush of FIG. 1.

With reference to FIGS. 1 and 2, a first embodiment of a modular brush 10 is shown as including a handle 12 and a cylindrical portion 14 extending from the handle. The handle has a configuration to facilitate manipulation by a user, but the configuration of the handle is not critical.

The handle 12 and the cylindrical portion 14 form a brush body. Preferably, the brush body is made of a rigid plastic. The cylindrical portion 14 meets the handle 12 at a shoulder 16. At the opposite end of the cylindrical portion, an externally-threaded member 18 is fixed in place. The externally-threaded member may be an integral part of the brush body.

FIG. 1 shows three bristle modules 20, 22 and 24 and one spacer module 26 that are fixed to the brush handle 12. Each of the modules 20–26 is a ring having a circular inside diameter and a polygonal exterior. An end cap 28 secures the modules onto the brush body.

The assembly of parts is shown more clearly in FIG. 2. Here, the modules include first and second bristle modules 30 and 32 and a spacer module 34. The inside diameter of each of the modules 30-34 is slightly greater than the diameter of the cylindrical portion 14 of the brush body. The modules slide onto the cylindrical portion of the brush body to abut the shoulder 16. The end cap 28 is then threaded onto the externally-threaded member 18 to fix the modules in place.

Referring again to FIG. 1, the bristle modules 20–24 contain arrays of closely packed bristles 36, 38, 40, 42, 44, 46 and 48. The individual bristles of the arrays 36–48 may be made of nylon. Each array acts in the same manner as an absorbent structure, such as a sponge, for a dripless retention of hair coloring solution after being dipped into the solution. The polygonal exterior of the bristle modules 20–24 provides a number of flat surfaces for mounting of the bristle arrays 36–48. Thus, the bristles are each coterminus and are less likely to drip after receiving a quantity of solution.

While nylon bristles are not critical, the bristle material should be non-absorbent, so that dye is easily transferred from the bristles to a person's hair. Moreover, non-absorbent material is more durable and is more easily cleaned, such as by flushing. Bristles having a diameter in the range of 0.01 to 0.012 inch provide sufficient rigidity without being so stiff as to cause discomfort upon contact with the user's scalp.

At opposite ends of each closely packed bristle array 36–48 is an array of spaced bristles 50 and 52. While the bristles 50 and 52 are not critical to the present invention, these bristles can provide a combing operation during the application of hair coloring. The tips of these bristles 50 and 52 are dipped within a molten plastic that is allowed to harden to form spherical members. Preferably the spaced bristles are made of a plastic having a rigidity sufficient to properly comb a user's hair. These bristles can be comb-like teeth bristles.

In operation, the brush 10 is dipped into a container of hair treatment solution, such as color dye. The closely packed arrays 36–48 have a density and a material makeup to pick up solution without dripping. The brush is moved in a rotating fashion along the length of a user's hair. As each bristle array makes contact with hair, a fresh supply of dye is provided for application.

The outermost bristle module 20 has a closely packed bristle array 36–44 on the six sides of the module. This arrangement will provide a continuous streak of highlighting or lowlighting to a user's hair. In comparison, the bristle modules 22 and 24 have planar sides without bristles. Consequently, the closely packed bristle arrays 46 and 48 of these modules will achieve shorter streaks. The present invention allows the user to select modules that will achieve a desired streak pattern. Streak lengths can be modified, as well as coloring shades. For example, a darkening solution can be applied at bristle array 46, while a lightening solution is applied at array 48.

When the modular brush 10 is rotated in a counterclockwise direction, as viewed from the end cap 28, the bristles 50 and 52 function to comb the hair, so as to aid in proper solution distribution. These bristles 50 and 52 are not critical, however.

In FIG. 2, only three modules 30–34 are shown. The three modules are larger in the direction of the axis of the cylindrical portion 14 than are the modules of FIG. 1. Alternatively, smaller modules may be used to achieve the same pattern by utilizing a second spacer module 34. In any case, the modules should extend across the entirety of the cylindrical portion 14, so that the modules are prevented from axially or rotationally moving during use. While not critical, the cylindrical portion may have a length of 3.5 inches and the modules may vary in size between 0.5, 0.75 and 1.0 inch.

The first bristle module 30 has an identical array 54, 56, 58, 60 and 62 on each of six sides. The second bristle module 32 has two bristle arrays 64 and 66. The arrays 64 and 66 are offset axially on the module 32. Thus, the arrays 64 and 66 will not form a continuous streak, but will instead shade different groupings of hair.

Figure 3:
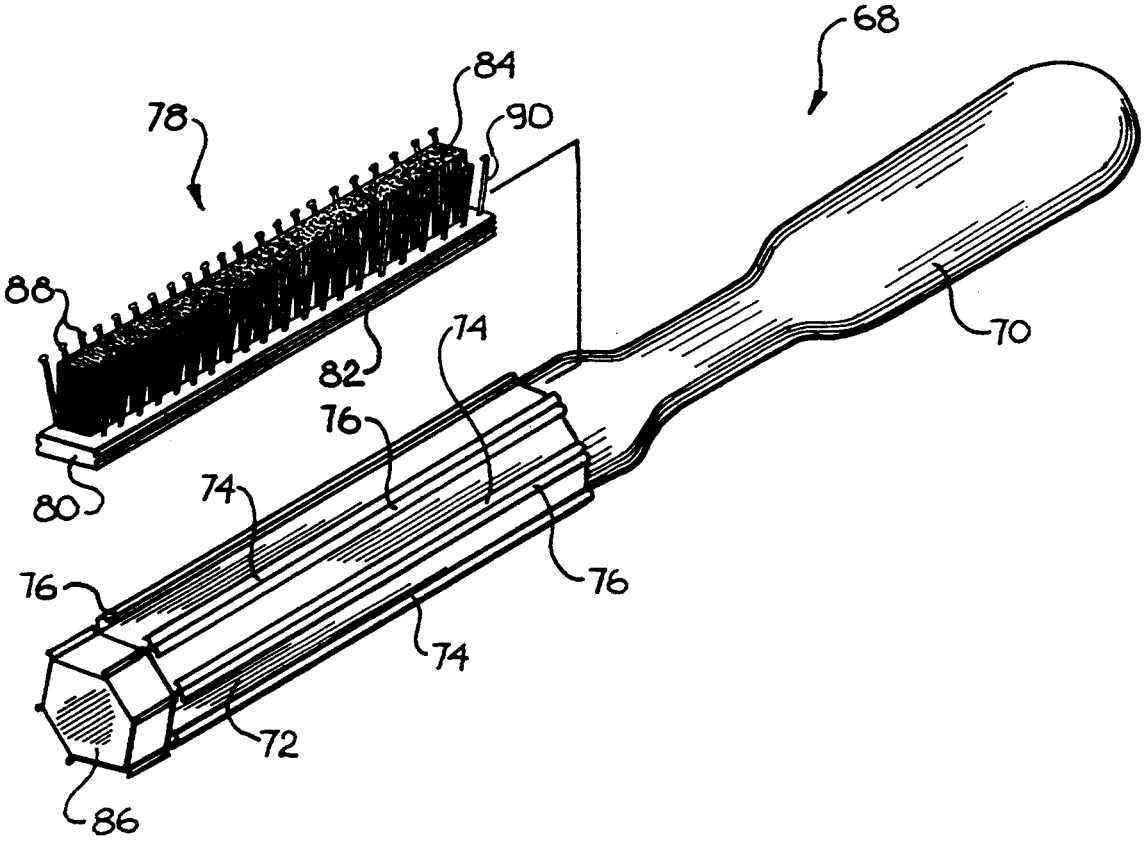
FIG. 3 is a perspective view of a second embodiment of a modular brush.

Referring now to FIG. 3, a modular brush 68 is shown as having a brush body that includes a handle 70 and a support region 72. The support region is a multi-sided structure that includes first and second flanges 74 and 76 on each side. A bristle module 78 includes a base 80 having longitudinal grooves 82 on opposed sides. The longitudinal grooves are positioned to receive the ends of the flanges 74 and 76, so as to fix the module in position.

Extending upwardly from the base 80 is a center array of tightly packed bristles 84 adapted, as described above, to retain a volume of hair treatment solution, such as dye. The center array 84 is a continuous pattern. Identical bristle modules may be slid into position on each side of the brush 68. An end cap 86 then locks the modules in place.

The center arrays 84 on the different sides of the brush 68 may be inserted into different shades of hair coloring, as desired. Thus, solutions will not become mixed as a user dips the brush 68 into the solutions in order to dye hair.

After a particular array 84 has been dipped into a supply of solution, the center array will retain a sufficient quantity of solution for the application. The brush is then moved in a direction to properly distribute the solution and to ready the hair for the next application. A first row of bristles 88 functions to comb the hair so as to aid in proper solution distribution. A second, trailing row of bristles 90 also serves to comb the user's hair.

Alternatively, the tightly packed bristle array may be segmented to form a number of separated arrays along one side of the brush 68. Identical modules 78 may be slid into place along the various sides of the brush, whereafter the brush may be used for hair streaking in the same manner as described with reference to FIGS. 1 and 2. This use of a plurality of bristle arrays having widthwise spacings is the preferred embodiment of the present invention.

Figure 4:
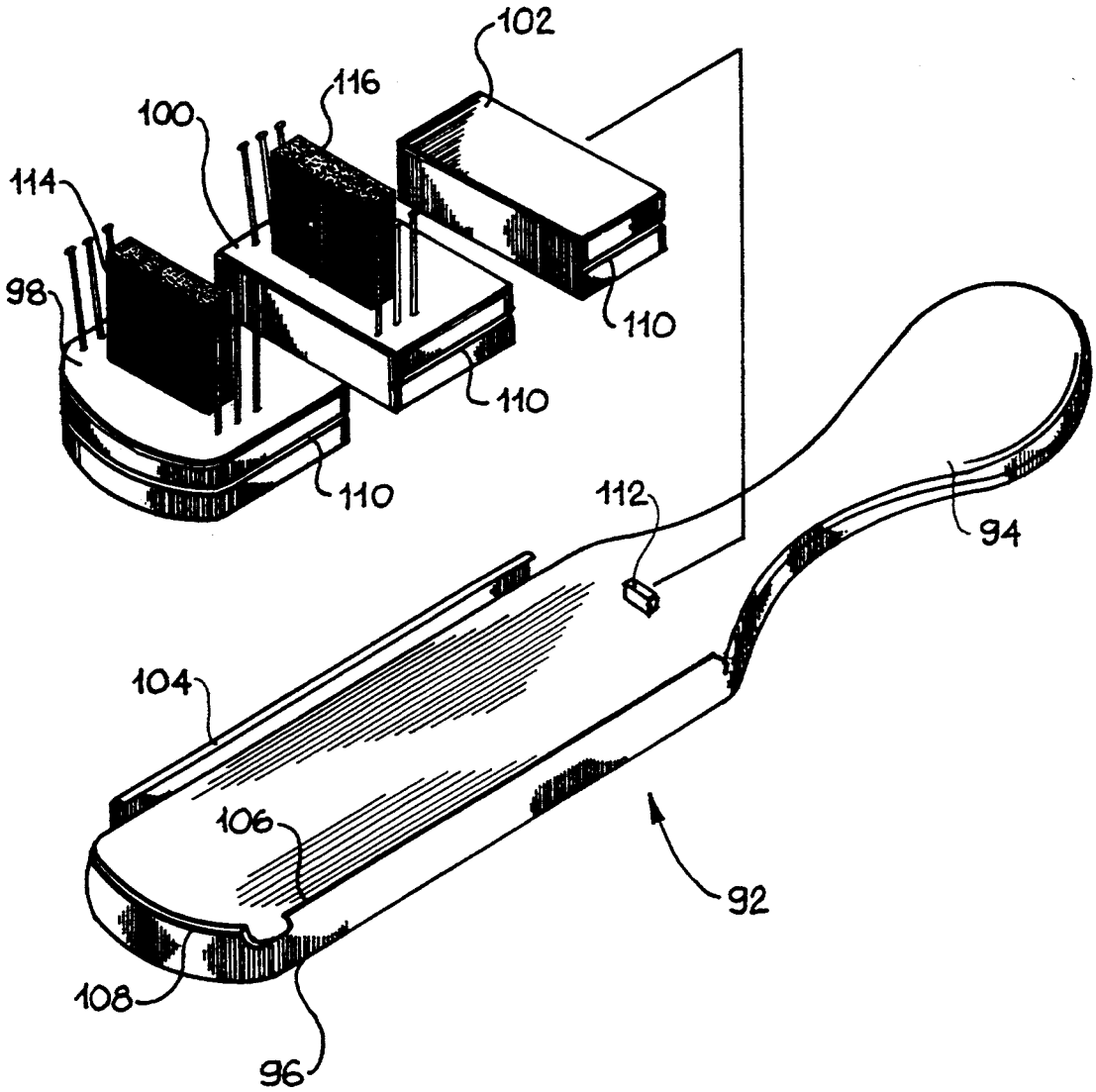
FIG. 4 is a perspective view of a third embodiment of a modular brush.

Referring now to FIG. 4, a modular brush 92 having a handle 94 and a support region 96 is shown. In this embodiment, the support region 96 includes a single side for receiving bristle modules 98 and 100 and a spacer module 102. The support region 96 has opposed flanges 104 and 106 and has a stop surface 108. Each of the modules 98–102 has grooves 110 positioned to receive the flanges 104 and 106. The mating of the flanges into the grooves blocks the modules with respect to widthwise movement, while the stop surface 108 and a locking button 112 prevent longitudinal movement. Optionally, the locking button is spring-loaded.

While not shown, the brush 92 includes a number of other modules that allow a user to select a pattern of bristles 114 and 116 and spaces. The pattern can be modified by depressing the locking button 112 to release the modules for rearrangement.

Because the brush 92 of FIG. 4 includes only a single side, the brush will not provide a fresh supply of solution with rotation of the brush. However, the embodiment of FIG. 4 is particularly suited for frosting and tipping.

Figure 5:
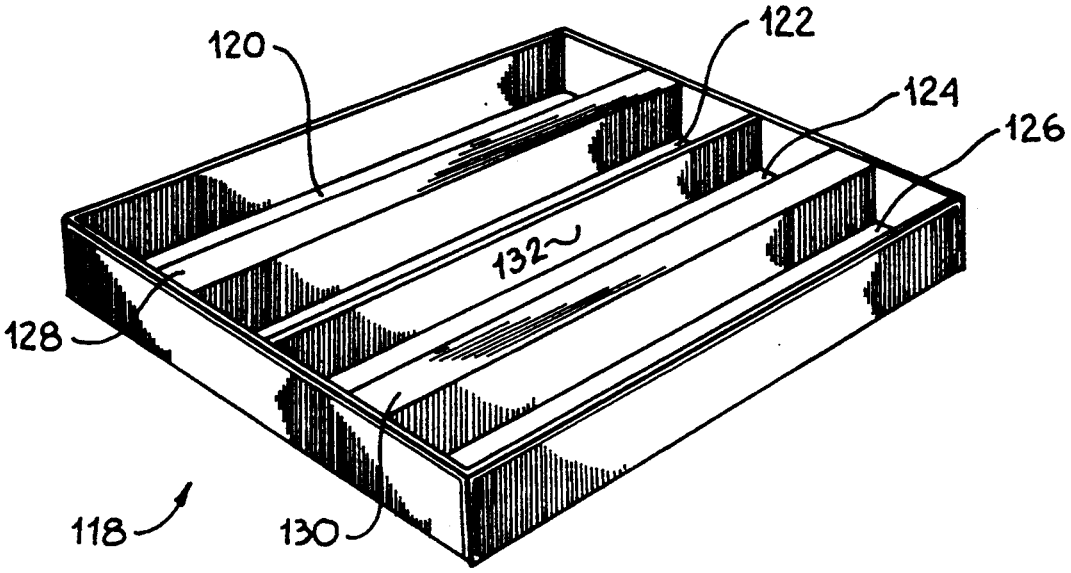
FIG. 5 is a perspective view of a modular dye-retaining tray for use with the brushes of FIGS. 1–4.

Referring now to FIG. 5, a modular tray 118 may be used to provide supplies of dye to the brushes described above. Four troughs 120, 122, 124 and 126 may be supplied with a single shade of hair coloring, or may each contain different shades. Trough 120 is separated from the adjacent trough 122 by a first step 128. A second step 130 separates troughs 124 and 126. In comparison, a substantially thinner wall 132 separates trough 122 from trough 124.

Figure 6:
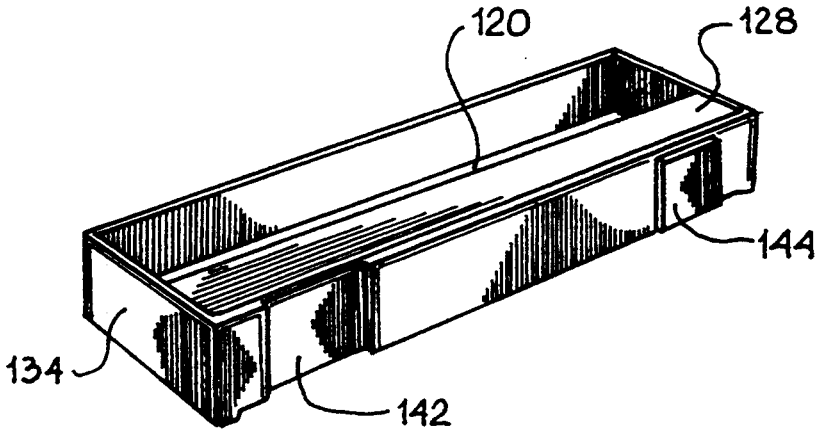
FIGS. 6–8 are perspective views of troughs of the tray of FIG. 5.
Figure 7:
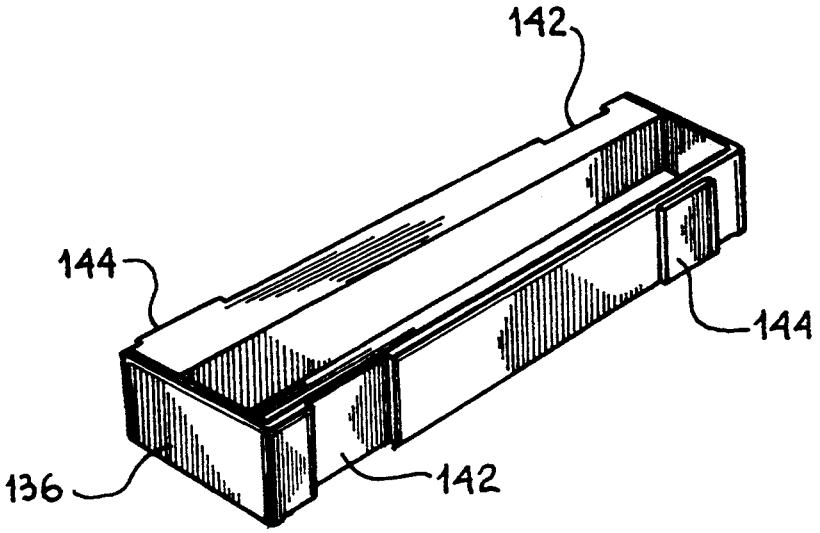
Figure 8:
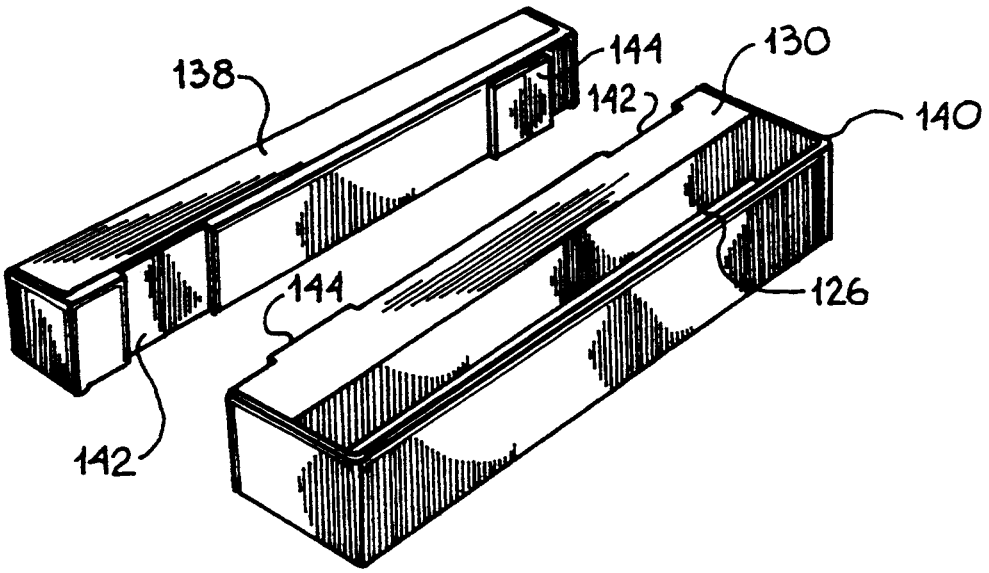

In operation, the user selects a desired hair streaking pattern. One of the modular brushes is then configured according to the selected pattern. The next step is to construct the tray 118 to provide troughs 120–126 that correspond to the bristle arrays of the brush. Referring to FIGS. 6–8, segments 134, 136, 138 and 140 may be used to form a modular tray. The segments slide vertically into contact with each other using flanged detents and projections 142 and 144, respectively. The segments may also be connected using means other than the detent-and-projection arrangement illustrated in the drawings. As best shown in FIG. 8, a step segment 138 may be connected to a trough segment 140 having a step 130 in order to provide a wide space between adjacent troughs.

The tray 118 is formed to provide troughs that are aligned with bristle patterns on a multi-sided module brush as described above. The brush is then inserted into the tray and is rotated so that each side receives a quantity of dye. In use, the brush is rotated so that each side of the brush provides a fresh supply of hair coloring.

In the claim:

1. A Modular brush for applying hair coloring in a user-selected pattern comprising, a brush body, said brush body having a length and a width, a plurality of polygonal bristle modules, each bristle module having a plurality of generally planar sides, at least some of said bristle modules having a pattern of closely packed bristles on each of a plurality of said planar sides, each of said patterns having a width perpendicular to said length of said brush body, adjacent patterns of bristles on adjacent planar sides of a bristle module having a widthwise spacing therebetween said bristles within each pattern of bristles having coterminous outer ends, and means for selectively arranging said plurality of bristle modules on said brush body to form a desired bristle configuration, whereby said patterns of bristles and widthwise spacings may be employed to form patterns of hair coloring.

2. The modular brush of claim 1 further comprising blank modules having an absence of bristles, said blank modules being selectively inserted between bristle modules to form spacing between adjacent bristle modules.

3. The modular brush of claim 1 wherein each pattern of bristles is a plurality of bristles having coterminous outer bristle ends that are tightly packed to retain a volume of hair coloring solution.

4. The modular brush of claim 1 wherein said bristle modules are rings slidably received on said brush body.

5. The modular brush of claim 1 wherein said bristle modules are arranged relative to each other to form different bristle configurations of coterminous bristles on different sides of said bristle modules.

6. A modular brush comprising, a brush body, a plurality of bristle modules releasably secured to said brush body to form a multi-sided configuration in which sides connect to form a continuous exterior, with bristle patterns projecting outwardly from a plurality of sides, said sides being planar, each bristle module having at least one array of bristles, each bristle pattern having generally coterminous bristles, and a spacer module releasably secured to said brush body between first and second bristle modules of said plurality of bristle modules to provide spaces along said bristle patterns on said plurality of sides, wherein said bristle patterns may be varied by rearrangement of said bristle modules and said spacer module along said brush body.

7. The brush of claim 6 wherein each side of said multi-sided configuration has an identical pattern of bristles and spaces.

8. The brush of claim 6 having a plurality of said spacer modules.

9. The brush of claim 6 wherein said bristle modules are rings having said planar sides to form a hexagonal configuration.

10. The brush of claim 9 wherein different sides of said polygonal configuration have different bristle patterns of coterminous bristles.

* * * * *